US011974712B2

(12) United States Patent
Durham et al.

(10) Patent No.: US 11,974,712 B2
(45) Date of Patent: May 7, 2024

(54) FLUID CIRCULATION ASSEMBLY FOR A DISHWASHER APPLIANCE

(71) Applicant: Haier US Appliance Solutions, Inc., Wilmington, DE (US)

(72) Inventors: Kyle Edward Durham, Louisville, KY (US); Adam Christopher Hofmann, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/942,511

(22) Filed: Sep. 12, 2022

(65) Prior Publication Data

US 2024/0081606 A1 Mar. 14, 2024

(51) Int. Cl.
*A47L 15/42* (2006.01)

(52) U.S. Cl.
CPC ..... *A47L 15/4225* (2013.01); *A47L 15/4208* (2013.01); *A47L 15/4219* (2013.01); *A47L 15/4223* (2013.01)

(58) Field of Classification Search
None
See application file for complete search history.

(56) References Cited

U.S. PATENT DOCUMENTS

| | | | | |
|---|---|---|---|---|
| 9,839,339 | B2 | 12/2017 | Dries | |
| 10,349,809 | B2 | 7/2019 | Dries et al. | |
| 10,349,810 | B2 | 7/2019 | Dries et al. | |
| 2008/0149148 | A1* | 6/2008 | Woo | A47L 15/4204 134/198 |
| 2014/0000664 | A1 | 1/2014 | Badafem et al. | |

FOREIGN PATENT DOCUMENTS

| | | | |
|---|---|---|---|
| CA | 2730502 | C | 1/2015 |
| EP | 3025627 | B1 | 5/2019 |
| KR | 100772228 | B1 | 11/2007 |

* cited by examiner

*Primary Examiner* — Levon J Shahinian
(74) *Attorney, Agent, or Firm* — Dority & Manning, P.A.

(57) ABSTRACT

A dishwasher appliance includes a wash tub defining a wash chamber, a sump housing defining a sump for collecting wash fluid, the sump housing defining a drain basin, and a fluid circulation assembly positioned within the sump. The fluid circulation assembly includes a drain cover seated within the drain basin, a wash pump assembly seated on top of the drain cover, a filter cleaning manifold positioned over the wash pump assembly, and a plurality of mechanical fasteners that pass through filter cleaning manifold and into the sump housing to attach the filter cleaning manifold to the sump housing and to secure the wash pump assembly and the filter cleaning manifold within the sump.

20 Claims, 8 Drawing Sheets

FLUID CIRCULATION ASSEMBLY FOR A DISHWASHER APPLIANCE

FIELD OF THE INVENTION

The present disclosure relates generally to dishwasher appliances, and more particularly to features for installing fluid circulation assemblies within dishwasher appliances.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a pump may periodically discharge soiled wash fluid that collects in the sump space and the process may be repeated.

Conventional dishwasher appliances include a wash system that includes one or more of a wash pump assembly, a drain pump assembly, and other components that are typically positioned in or around the sump for facilitating dishwasher operation. These components are typically time consuming and costly to mount, requiring multiple fastening methods for each of the plurality of components. Moreover, the fasteners commonly used to mount these components often introduce leak points in the sump, thereby increasing the likelihood of wash fluid leaks and appliance or household damage. In addition, conventional mounting methods often permit excessive vibration, noise, and/or premature wear of installed components.

Accordingly, a dishwasher appliance that includes a wash system that is installed with fewer components and fasteners would be useful. More specifically, a wash system that is cost-effective and easy to install in a secure manner would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a dishwasher appliance defining a vertical direction if provided. The dishwasher appliance includes a wash tub that defines a wash chamber, a sump housing defining a sump for collecting wash fluid, the sump housing defining a drain basin, and a fluid circulation assembly positioned within the sump. The fluid circulation assembly includes a drain cover seated within the drain basin, a wash pump assembly seated on top of the drain cover, a filter cleaning manifold positioned over the wash pump assembly, and a plurality of mechanical fasteners that pass through filter cleaning manifold and into the sump housing to attach the filter cleaning manifold to the sump housing and to secure the wash pump assembly and the filter cleaning manifold within the sump.

In another exemplary embodiment, a fluid circulation assembly for a dishwasher appliance is provided. The dishwasher appliance defining a vertical direction and includes a wash tub that defines a wash chamber and a sump housing defining a sump for collecting wash fluid, the sump housing defining a drain basin. The fluid circulation assembly includes a drain cover seated within the drain basin;

a wash pump assembly seated on top of the drain cover, a filter cleaning manifold positioned over the wash pump assembly, and a plurality of mechanical fasteners that pass through filter cleaning manifold and into the sump housing to attach the filter cleaning manifold to the sump housing and to secure the wash pump assembly and the filter cleaning manifold within the sump.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
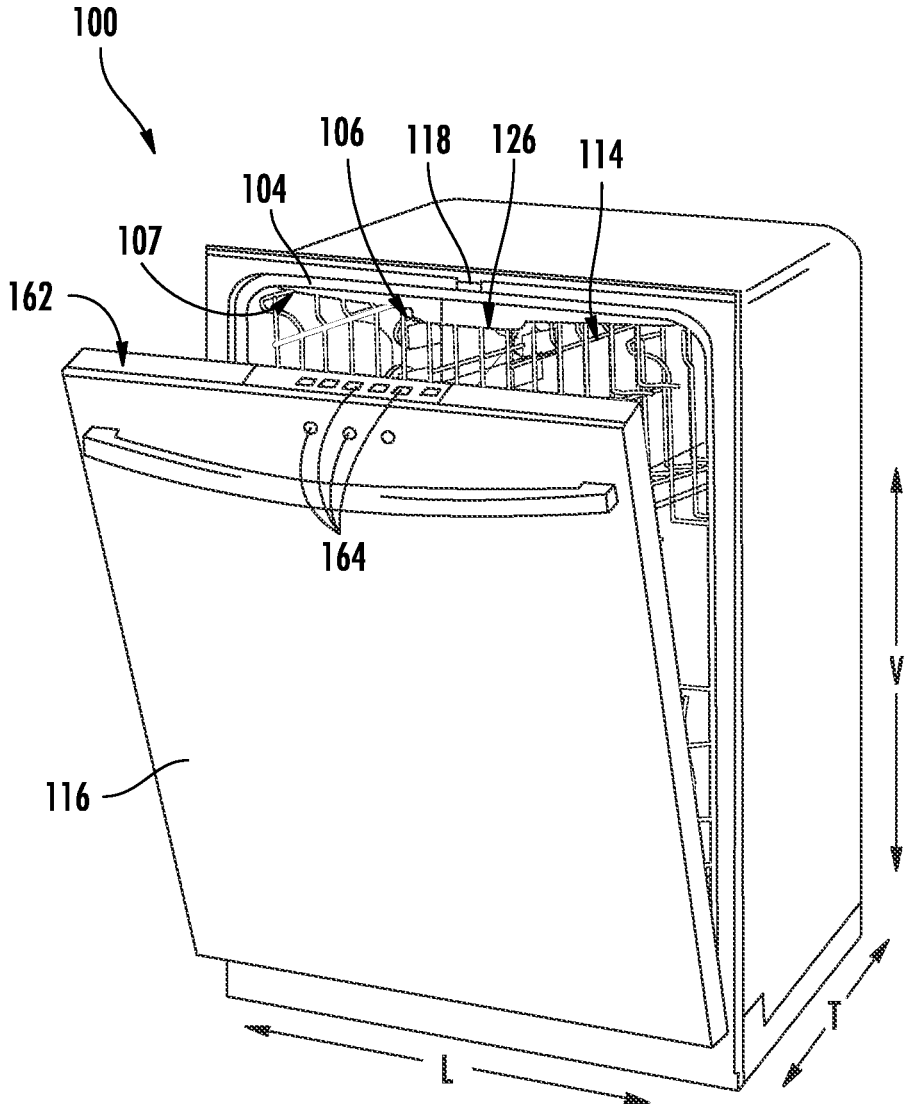
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
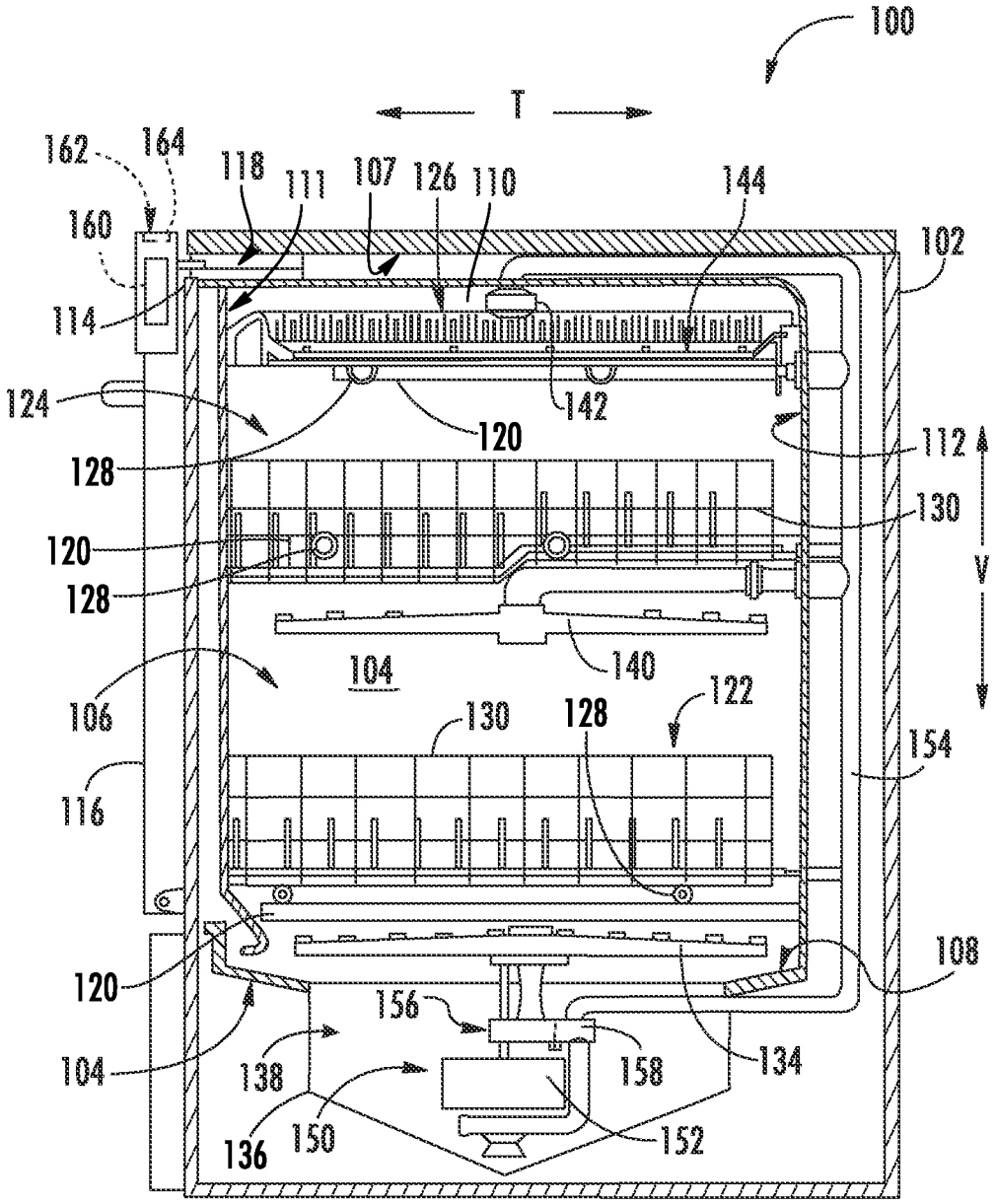
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region of wash chamber 106. Specifically, dishwasher 100 may include a sump housing 136 that is positioned at a bottom of tub 104, the sump housing 136 defining a sump space (referred to herein generally as a sump 138). According to example embodiments, lower spray arm assembly 134 is positioned in the lower region of wash chamber 106, e.g., just above sump 138, to rotate in relatively close proximity to lower rack assembly 122.

Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for supplying a filter cleaning assembly 250, which will be described in more detail below according to an exemplary embodiment.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Referring now generally to FIGS. 3 through 9, fluid circulation assembly 150 will be described according to an example embodiment of the present subject matter. Fluid circulation assembly 150 may include a drive motor 170 that may be disposed within sump 138 of tub 104 and may be configured to rotate multiple components of dishwasher 100. As illustrated, drive motor 170 may be, for example, a brushless DC motor having a stator 172, a rotor 174, and a drive shaft 176 attached to rotor 174. A controller or control board (not shown) may control the speed of motor 170 and rotation of drive shaft 176 by selectively applying electric current to stator 172 to cause rotor 174 and drive shaft 176 to rotate. Although drive motor 170 is illustrated herein as a brushless DC motor, it should be appreciated that any suitable motor may be used while remaining within the scope of the present subject matter. For example, according to alternative embodiments, drive motor 170 may instead be a synchronous permanent magnet motor.

According to an example embodiment, drive motor 170 may be a variable speed motor. In this regard, drive motor 170 may be operated at various speeds depending on the current operating cycle of the dishwasher. For example, according to an exemplary embodiment, drive motor 170 may be configured to operate at any speed between a minimum speed, e.g., 1500 revolutions per minute (RPM), to a maximum rated speed, e.g., 4500 RPM. In this manner, use of a variable speed drive motor 170 enables efficient operation of dishwasher 100 in any operating mode. Thus, for example, the drain cycle may require a lower rotational speed than a wash cycle and/or rinse cycle. A variable speed drive motor 170 allows impeller rotation at the desired speeds while minimizing energy usage and unnecessary noise when drive motor 170 does not need to operate at full speed.

According to an exemplary embodiment, drive motor 170 and all its components may be potted. In this manner, drive motor 170 may be shock-resistant, submersible, and generally more reliable. Notably, because drive motor 170 is mounted inside wash chamber 106 and is completely submersible, no seals are required and the likelihood of leaks is reduced. In addition, because drive motor 170 is mounted in the normally unused space between lower spray arm assembly 134 and a bottom wall of sump 138, instead of beneath the sump 138, this design is inherently more compact than conventional designs.

Figure 3:
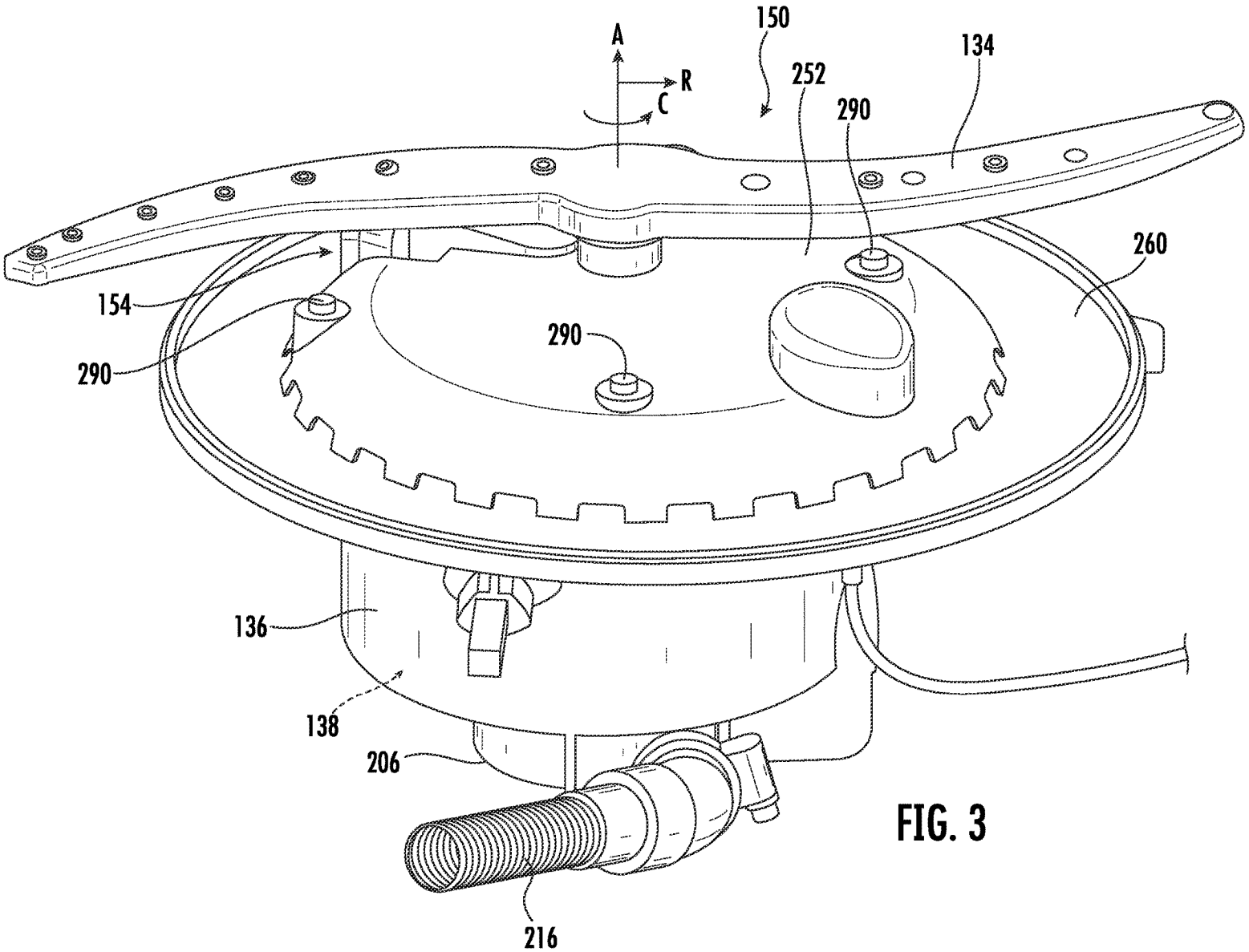
FIG. 3 provides a perspective view of certain components of a fluid circulation assembly according to an example embodiment of the present subject matter.
Figure 4:
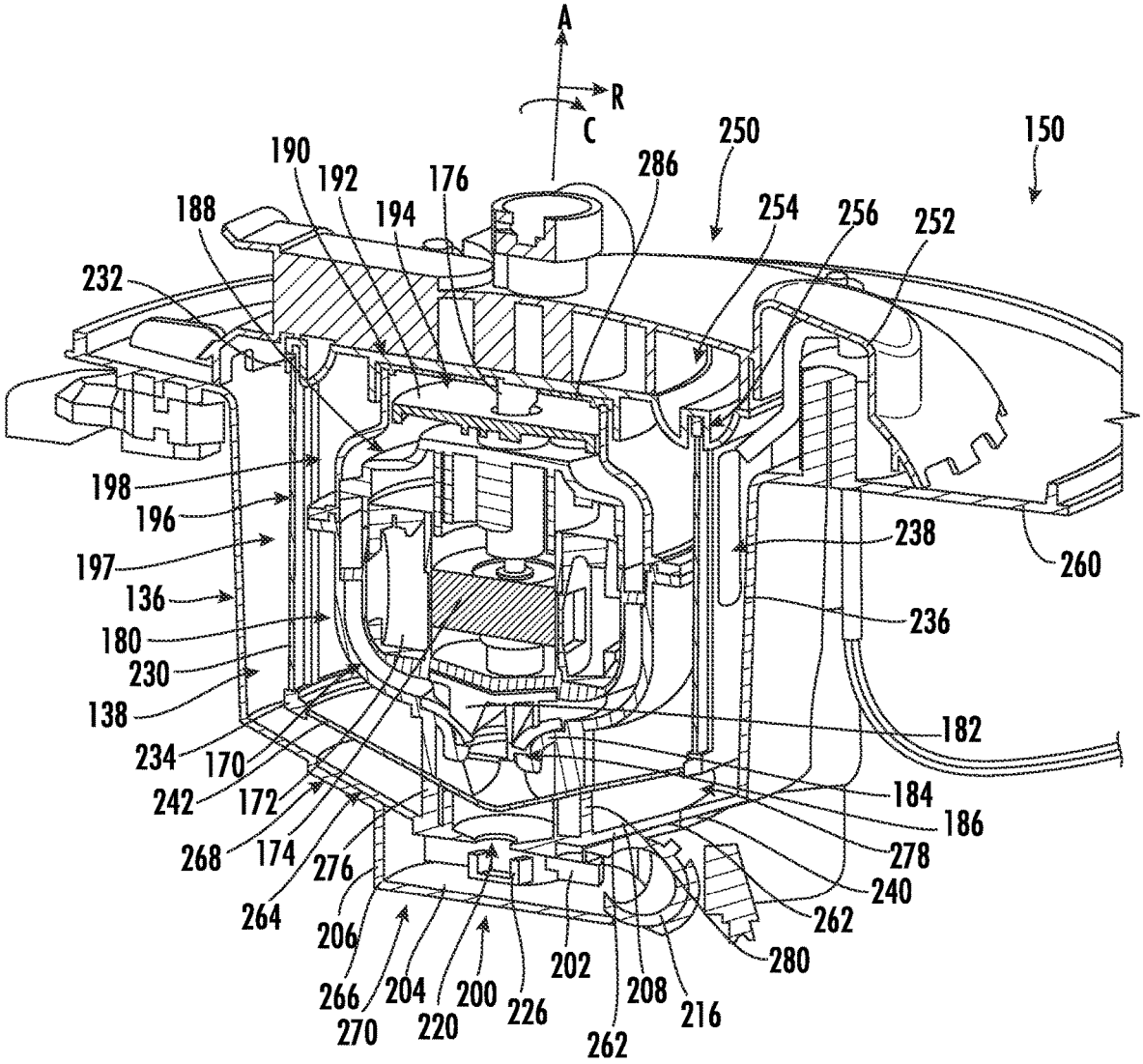
FIG. 4 provides a perspective, cross sectional view of the exemplary fluid circulation assembly of FIG. 3 according to an example embodiment of the present subject matter.

According to an exemplary embodiment, fluid circulation assembly 150 may be vertically mounted within sump 138 of wash chamber 106. More particularly, drive motor 170 of fluid circulation assembly 150 may be mounted such that drive shaft 176 is oriented along vertical direction V of dishwasher 100. More particularly, drive shaft 176 may define an axial direction A, a radial direction R, and a circumferential direction C (FIG. 3), with the axial direction A being parallel to the vertical direction V of the dishwasher 100. As illustrated in FIG. 4, drive shaft 176 is rotatably supported by upper and lower bearings and extends out of a bottom of drive motor 170 toward a bottom of sump 138.

As illustrated, drive shaft 176 is configured for driving a circulation or wash pump assembly 180. Wash pump assembly 180 may generally be configured for circulating wash fluid within wash chamber 106 during wash and/or rinse cycles. More specifically, wash pump assembly 180 may include a wash pump impeller 182 disposed on drive shaft 176 within a pump housing 184. Pump housing 184 defines a pump intake 186 for drawing wash fluid into wash pump impeller 182. According to the illustrated embodiment, pump intake 186 is facing downward along the vertical direction V and is located very near the bottom of sump 138. In this manner, the amount of water required to prime and operate wash pump assembly 180 is minimized. This is particularly advantageous when running low water cycles for the purpose of water and energy savings.

As shown in FIG. 4, pump housing 184 is in fluid communication with a supply conduit 188 through which pressurized wash fluid may be recirculated through fluid circulation assembly 150. More specifically, according to the illustrated embodiment, wash pump impeller 182 draws wash fluid in from sump 138 and pumps it through supply conduit 188 to a diverter assembly 190 (such as diverter assembly 156) which generally distributes the flow of wash fluid as desired within dishwasher 100.

As shown in FIG. 4, diverter assembly 190 may include a diverter disc 192 disposed within a diverter chamber 194 (such as diverter chamber 158). Diverter chamber 194 is fluidly coupled to supply conduit 188, such that rotating diverter disc 192 may selectively distribute the flow of wash fluid to the spray arm assemblies 134, 140, 142, filter cleaning assembly 250, or any other fluid conduit coupled to diverter chamber 194. More particularly, diverter disc 192 may be rotatably mounted about the vertical direction V. Diverter disc 192 may have a plurality of apertures that are configured to align with a one or more outlet ports at the top of diverter chamber 194. In this manner, diverter disc 192 may be selectively rotated to provide wash fluid to spray arm assemblies 134, 140, 142 or filter cleaning assembly 250.

As illustrated, fluid circulation assembly 150 further includes a filter screen or filter 196. In general, filter 196 may define an unfiltered region 197 and a filtered region 198 within sump 138. During a wash or rinse cycle, wash fluid sprayed on dishes or other articles within wash chamber 106 falls into the unfiltered region 197. Wash fluid passes through filter 196 which removes food particles, resulting in relatively clean wash fluid within the filtered region 198. As used herein, "food particles" refers to food soil, particles, sediment, or other contaminants in the wash fluid which are not intended to travel through filter 196. Thus, a food particle seal may allow water or other wash fluids to pass from the unfiltered region 197 to the filtered region 198 while preventing food particles entrained within that wash fluid from passing along with the wash fluid.

As illustrated, filter 196 is a cylindrical and conical fine mesh filter constructed from a perforated stainless steel plate. Filter 196 may include a plurality of perforated holes, e.g., approximately $^{15}/_{1000}$ of an inch in diameter, such that wash fluid may pass through filter 196, but food particles entrained in the wash fluid do not pass through filter 196. However, according to alternative embodiments, filter 196 may be any structure suitable for filtering food particles from wash fluid passing through filter 196. For example, filter 196 may be constructed from any suitably rigid material, may be formed into any suitable shape, and may include apertures of any suitable size for capturing particulates.

According to the illustrated exemplary embodiment, filter 196 defines an aperture through which drive shaft 176 extends. Wash pump impeller 182 is coupled to drive shaft 176 above filter 196 and a drain pump assembly (e.g., as described below) is coupled to drive shaft 176 below filter 196 along the vertical direction V. Fluid circulation assembly 150 may further include an inlet guide assembly (not labeled) which is configured for accurately locating and securing filter 196 while allowing drive shaft 176 to pass through aperture and minimizing leaks between the filtered and unfiltered regions 197, 198 of sump 138. More specifically, as best illustrated in FIG. 4, drive shaft 176 passes through a clearance bore in inlet guide assembly and through filter 196 between unfiltered region 197 and filtered region 198 of sump 138. Because the clearance bore has a diameter that is larger than the diameter of drive shaft 176, inlet guide assembly may further include a washer disposed within a chamber, e.g., in order to accommodate minor drive shaft wobble or misalignment while retaining a particle tight seal.

Referring still to FIGS. 4 through 7, a drain pump assembly 200 according to an exemplary embodiment of the present subject matter will be described. Drain pump assembly 200 may generally be configured for periodically discharging soiled wash fluid from dishwasher 100. Although illustrated and described as part of fluid circulation assembly 150, it should be appreciated that aspects of drain pump assembly 200 may be used in any impeller assembly in any application where it is desirable to selectively pump a fluid. In this regard, drain pump assembly 200 is only one exemplary configuration used for the purpose of explaining aspects of the present subject matter and is not intended to limit the scope of the invention in any manner.

Drain pump assembly 200 may include a drain pump impeller 202 coupled to a bottom portion of drive shaft 176 and positioned within a drain volute 204 below filter 196. More specifically, drain volute 204 is defined by a drain basin 206 of sump 144 and a drain cover 208 that positioned over drain basin 206 and forms a fluid tight seal with drain basin 206, e.g., by using an O-ring or any other suitable sealing mechanism. According to the illustrated embodiment, the bottom of sump 138 and drain cover 208 define a seamless transition and are cone-shaped to help funnel food particles toward drain volute 202. For example, as illustrated, sump 138 and drain cover 208 define a frustum of a cone above drain basin 206.

As illustrated, drain pump assembly 200 further includes a discharge conduit 216 (FIG. 3) that extends from drain basin 206 and is in fluid communication with drain volute 204. Drain cover 208 defines a drain inlet 220 through which wash fluid may pass into drain volute 204. As illustrated, drain inlet 220 is a circular aperture in the center of drain cover 208, but other sizes and geometries may be used according to alternative embodiments. As illustrated drive shaft 176 passes through drain inlet 220 into drain volute 204 where it is coupled to drain pump impeller 202. During a drain cycle, drain pump impeller 202 draws soiled wash fluid through drain inlet 220 into drain volute 204 and discharges it through discharge conduit 216.

Notably, drain pump impeller 202 is coupled to the bottom portion of drive shaft 176 using a one-way clutch 226. In this regard, during a wash/rinse cycle, drive motor 170 rotates in one direction, pumping filtered wash fluid using wash pump impeller 182. However, one-way clutch 226 is disengaged, so drain pump impeller 202 does not rotate at the same speed. Instead, drain pump impeller 202 may rotate at a decreased speed, e.g., due to some friction between one-way clutch 226 and drive shaft 176. According to alternative embodiments, drain pump impeller 202 may remain stationary during the wash cycle or may rotate at the same speed as wash pump impeller 182. In both cases, soil and food particles will have a tendency to collect within drain volute 204, as described herein. By contrast, during a drain cycle, drive motor 170 rotates in the opposite direction, thereby engaging one-way clutch 226 and causing drain pump impeller 202 to rotate and discharge wash fluid.

As illustrated, drain inlet 220 is positioned at a center of drain cover 208 and is sized such that wash fluid and large food particles may pass into drain volute 204. However, drain cover 208 also acts as a barrier to prevent soil that collects around a perimeter of drain volute 204 from escaping drain volute 204, e.g., along the vertical direction V. In this manner, as drain pump impeller 202 rotates, soil and food particles are urged radially outward within drain basin 206 where they are trapped and collect until a drain cycle is initiated. When drive shaft 176 is rotated in the drain direction, wash fluid and soils collected in drain volute 204 are quickly and efficiently expelled through discharge conduit 216.

Drain pump volute 202 and discharge conduit 216 are both positioned at the very bottom of sump 138, at the lowest portion of fluid circulation assembly 150, providing several operational advantages. Specifically, heavier soil tends to fall toward drain volute 204 where wash fluid and food particles are collected. During a drain cycle, drain pump impeller 202 is rotated and soiled wash fluid is discharged from dishwasher 100 through a discharge conduit 216 such that complete draining of soiled wash fluid may be achieved. After some or all of the soiled wash fluid is discharged, fresh water and/or wash additives may be added and the wash or rinse cycle may be repeated.

It should be appreciated that drain pump assembly 200 is used only for the purpose of explaining aspects of the present subject matter. Modifications and variations may be made to drain pump assembly 200 while remaining within the scope of the present subject matter. For example, the number, size, spacing, and configuration of vanes of drain pump impeller 202 may be adjusted while remaining within the scope of the present subject matter.

Drain pump assembly 200 as described above enables both wash pump impeller 182 and drain pump impeller 202 of fluid circulation system 150 to be placed on a single drive shaft 176. In this manner, a single, reversible drive motor 170 can rotate drive shaft 176 in a first direction for wash/rinse cycles and in the opposite direction for drain cycles. More specifically, according to the illustrated embodiment, drive motor 170 and wash pump assembly 180 are positioned within filtered region 198, while drain pump assembly 200 is positioned within unfiltered region 197. Furthermore, because drain pump impeller 202 rotates relatively slowly during the wash cycle, drain pump impeller 202 draws food particles and soil into drain volute 204 and urges them radially outward to trap them in drain volute 204. In this manner, wash fluid circulated within wash chamber 106 has a lower soil content and can facilitate more effective cleaning of articles placing in the dishwashing racks. In addition, the soil is trapped or contained proximate discharge conduit 216 for effective discharge when drain pump impeller 202 is rotated in the drain direction.

Referring to FIGS. 4 through 6 and 9, filter screen 196 will be described in more detail according to example embodiments of the present subject matter. In this regard, as illustrated, filter screen 196 may generally include a cylindrical filter screen 230 that surrounds wash pump assembly 180, e.g., extending about the circumferential direction C and being substantially concentric with drive shaft 176. According to the illustrated embodiment, cylindrical filter screen 230 may generally extend along the vertical direction V between a top end 232 positioned proximate a top of sump 138 and a bottom end 234 positioned proximate a bottom of sump 138.

In addition, according to example embodiments, sump housing 136 may include a cylindrical sump wall 236 that extends from a bottom of wash tub 104 downward along the vertical direction V toward drain basin 206. As shown, cylindrical filter screen 230 may be concentric with cylindrical sump wall 236 and may define an annular plenum 238 therebetween. In general, this annular plenum 238 may correspond with unfiltered region 197 of sump 138, while the interior of cylindrical filter screen 230 may correspond to filtered region 198.

In addition, sump housing 136 may include a conical sump wall 240 that extends from cylindrical sump wall 236 inward along the radial direction toward drain volute 204. In order to prevent debris and soil from unfiltered region 197 from passing into filtered region 198 from within this lower portion of sump 138, filter screen 196 may further include a conical filter screen 242 positioned at bottom end 234 of the cylindrical filter screen 230. In general, conical filter screen 242 may form a continuous filter (e.g., filter screen 196) extending from cylindrical filter screen 230 and may be substantially parallel to conical sump wall 240. In this regard, annular plenum 238 may extend from wash tub 104 all the way into drain basin 206 and drain volute 204, while maintaining a substantial debris shield between unfiltered region 197 and filtered region 198.

Referring now generally to FIGS. 3 through 5 and 9, a filter cleaning assembly 250 according to an exemplary embodiment of the present subject matter will be described. Filter cleaning assembly 250 may generally be configured for intermittently or continuously cleaning or dislodging food particles or soil from a filter screen of a dishwasher appliance, such as filter screen 196 (including cylindrical filter screen 230 and conical filter screen 242). Although illustrated and described as part of fluid circulation assembly 150, it should be appreciated that aspects of filter cleaning assembly 250 may be used in any appliance where it is desirable to filter a fluid and periodically clean the filter. In this regard, filter cleaning assembly 250 is only one exemplary configuration used for the purpose of explaining aspects of the present subject matter and is not intended to limit the scope of the invention in any manner.

According to the illustrated embodiment, filter cleaning assembly 250 includes a filter cleaning manifold 252 that is positioned proximate filter screen 196, e.g., on top of cylindrical filter screen 230 along the vertical direction V. Filter cleaning manifold 252 may include a lower manifold housing and an upper manifold housing that are joined to define a wash fluid plenum 254 that is in fluid communication with supply conduit 188 through diverter chamber 194. In addition, filter cleaning assembly 250 includes a plurality of cleaning ports (not labeled) that are in fluid communication with wash fluid plenum 254. In this manner, filter cleaning manifold 252 is generally configured for receiving a flow of wash fluid when diverter disc 192 is positioned such that wash fluid plenum 254 is in fluid communication with diverter chamber 194.

As shown, filter cleaning manifold 252 is a circular manifold positioned all the way around the top of cylindrical filter screen 196. In this manner, wash fluid plenum 254 is generally an annular chamber that distributes the flow of wash fluid around an entire circumference of filter screen 196. More specifically, according to an exemplary embodiment, filter cleaning manifold 252 is positioned above the filter screen 196 along the vertical direction V. In addition, according to one embodiment, filter cleaning manifold 252 defines a circular filter receiving slot 256 having a diameter substantially equivalent to the diameter of filter screen 196. As shown, filter screen 196 is received within slot 256 to secure filter cleaning manifold 252 to filter screen 196.

According to the illustrated embodiment, filter screen 196 is received within slot 256 defined by filter cleaning manifold 252. Thus, filter screen 196 may generally be compression fit within slot 256. However, it should be appreciated that filter screen 196 may be mounted to the filter cleaning manifold 252 using one or more mechanical fasteners, such as screws, bolts, rivets, etc. Alternatively, glue, welding, snap-fit mechanisms, interference-fit mechanisms, or any suitable combination thereof may secure filter screen 196 to filter cleaning manifold 252.

It may be desirable to intermittently flush filter screen 196 during the wash cycle. To achieve such filter cleaning, controller 160 may be programmed to rotate diverter disc 192 to a filter cleaning position where an aperture defined in diverter disc 192 directs the flow of wash fluid from diverter chamber 194 into filter cleaning manifold 252, which may define a plurality of discharge ports. The wash fluid is thus ejected directly onto and over filter screen 196 to facilitate the cleaning process, which may be repeated intermittently throughout a wash cycle, e.g., by alternating between providing wash fluid to the spray arm assemblies and the filter cleaning assembly 250. Alternatively, this cleaning process may be performed once at the end of a wash cycle, once at the beginning of a wash cycle, etc.

Referring now generally to FIGS. 3 through 9, a system for installing fluid circulation assembly 150 within dishwasher appliance 100 is described according to an example embodiment. As explained above, conventional dishwashers include numerous wash pumps, drain pumps, diverter assemblies, and other components that require a large number of fasteners and require complex, time-consuming, and costly assembly processes. Accordingly, the installation system and method described herein is generally directed to a simplified manner of installing a fluid circulation assembly in a dishwasher. Although the system is described as being used to install fluid circulation assembly 150 within dishwasher appliance 100, it should be appreciated that aspects of the present subject matter may be applicable to other fluid circulation systems and appliances.

In general, the installation or attachment system for fluid circulation assembly 150 described herein provides a simple cost-effective way to install the various components fluid circulation system 150. For example, wash pump assembly 180 may be separately assembled and coupled to drain cover 208, after which the assembly may be seated directly in sump 138. In order to secure wash pump assembly 180 in sump 138 (e.g., to prevent it from being movable along the vertical direction V), filter cleaning manifold 252 may be mounted over wash pump assembly 180 to fix the vertical position of wash pump assembly 180. Detail regarding this installation process will be provided below.

As best shown in FIGS. 3 through 5 and 7, sump housing 136 generally includes an upper wall 260 which is positioned above sump 138 along the vertical direction V. In this regard, upper wall 260 may form a portion of the bottom of tub 104. As illustrated, upper wall 260 may be angled slightly downward along the vertical direction V toward sump 138, e.g., to facilitate the flow and collection of wash fluid in sump 138. Sump housing 136 may further include cylindrical sump wall 236 which extends substantially along the vertical direction V from a radially inner portion of upper wall 260. At the bottom of cylindrical sump wall 236, conical sump wall 240 may extend inward and at a downward angle toward drain basin 206. In this regard, all collected wash fluid may have the tendency to flow toward drain basin 206 where it may be discharged through discharge conduit 216.

Figure 6:
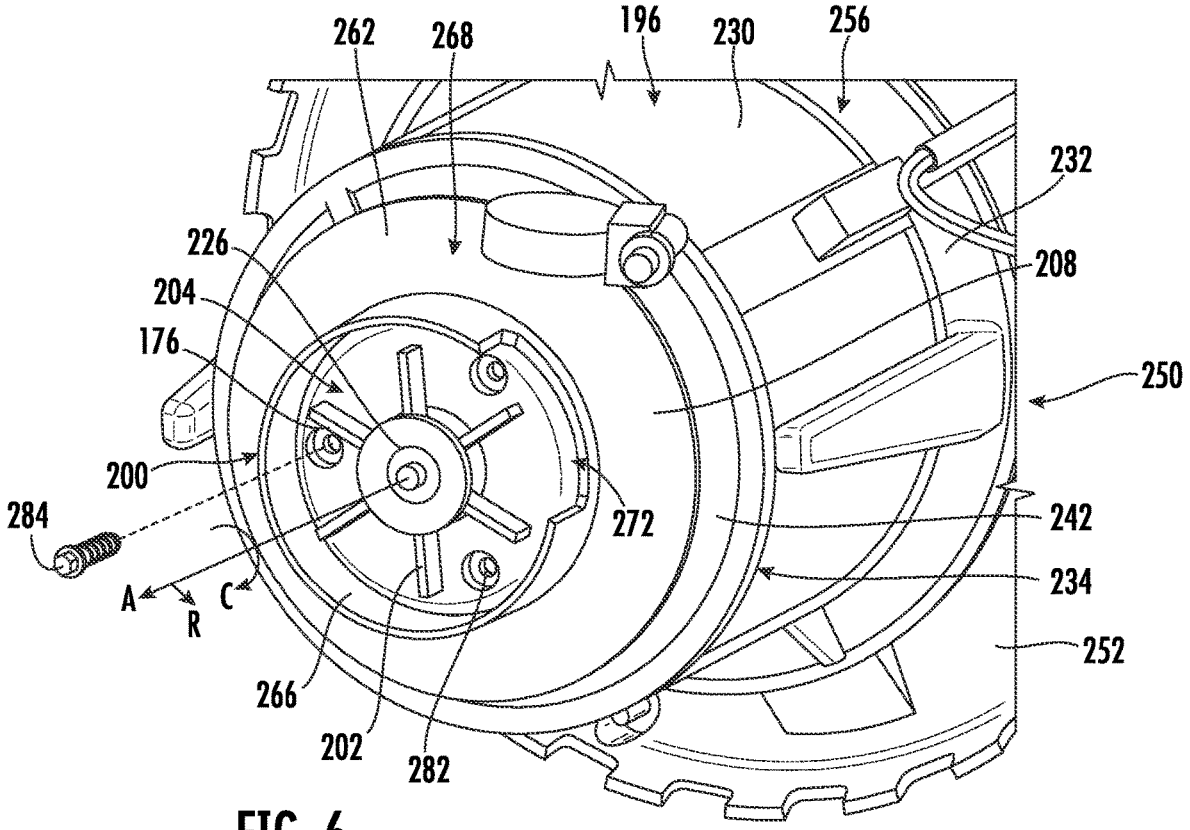
FIG. 6 provides a bottom, perspective view of the exemplary fluid circulation assembly of FIG. 3, removed from the sump according to an example embodiment of the present subject matter.
Figure 8:
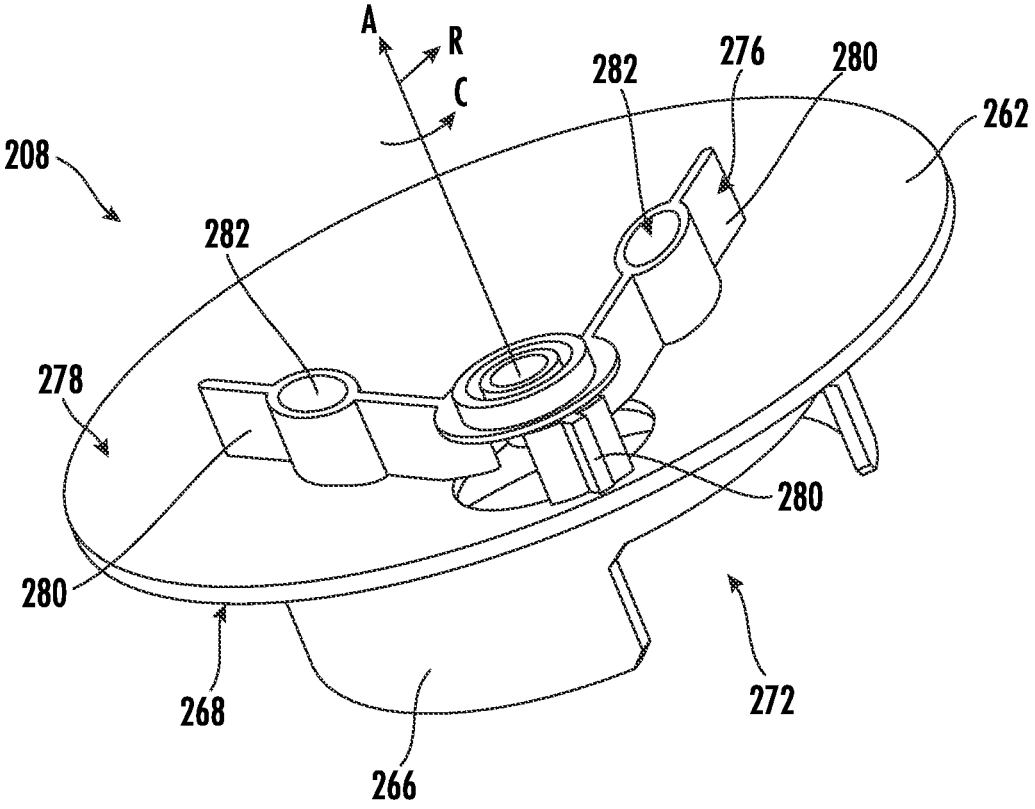
FIG. 8 provides a perspective view of a drain cover of the exemplary fluid circulation assembly of FIG. 3 according to an example embodiment of the present subject matter.

Referring now specifically to FIGS. 6 and 8, fluid circulation assembly 150 may include drain cover 208 which may be designed and configured for being seated at least partially within drain basin 206. For example, according to the illustrated embodiment, drain cover 208 may define a conical seat 262 which is generally configured for engaging conical sump wall 240. More specifically, according to the illustrated embodiment, conical sump wall 240 may define a conical recess 264 adjacent to drain basin 206 within which conical seat 262 may be seated. Notably, conical recess 264 and conical seat 262 may be designed to have a tight tolerance and engagement with each other. In this manner, a substantial fluid seal between conical sump wall 240 and conical seat 262 may be obtained to prevent fluid from within drain basin 206 escaping out into filtered region 198.

In addition, drain cover 208 may define a circumferential wall 266 that extends down from a bottom surface 268 of drain cover 208 (e.g., about the bottom of conical seat 262). In general, circumferential wall 266 is sized and oriented for seating against a bottom wall 270 of drain basin 206 when drain cover 208 is in the installed position. In this manner, all vertical force exerted on drain cover 208 may be distributed both through circumferential wall 266 and conical seat 262 directly onto sump housing 136. For example, according to the illustrated embodiment, the only place that wash pump assembly 180, filter screen 196, and drain pump assembly 200 contacts sump housing 136 is directly through drain cover 208.

Figure 7:
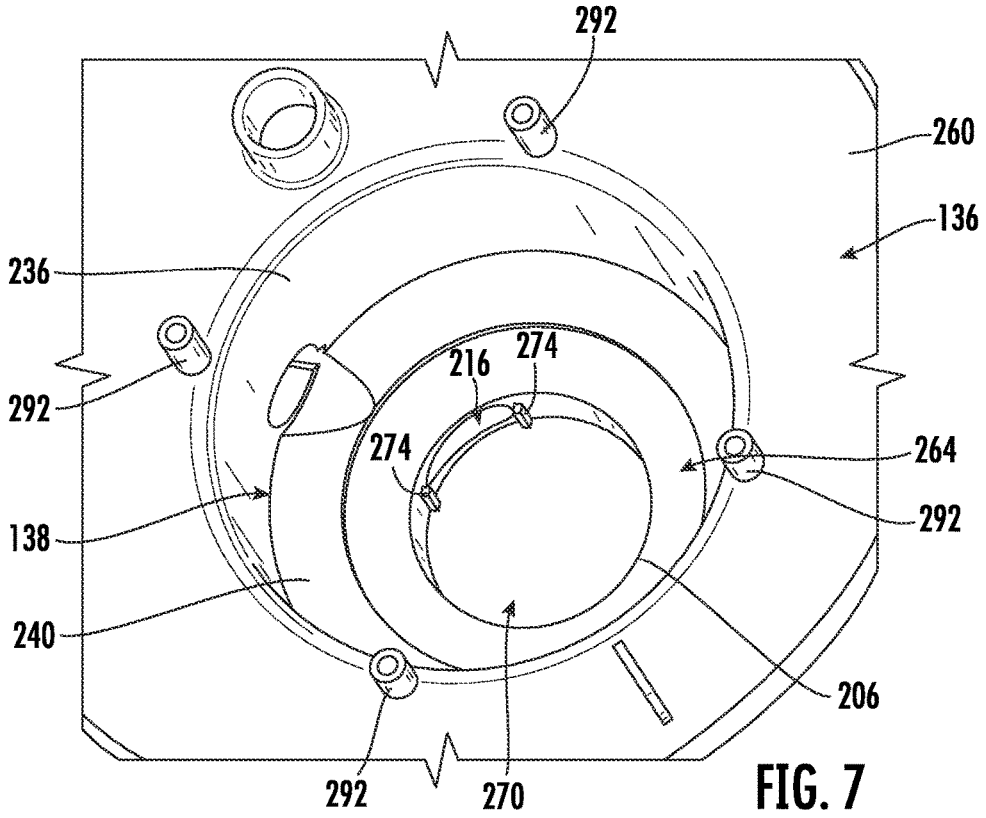
FIG. 7 provides a top, perspective view of the sump of an exemplary dishwasher appliance according to an example embodiment of the present subject matter.

Notably, as explained above, discharge conduit 216 extends radially out of a side of drain basin 206. Accordingly, circumferential wall 266 may define a cutout 272 that extends along the circumferential direction C through circumferential wall 266 to permit wash fluid to be discharged from drain basin 206 through discharge conduit 216. Notably, it may be desirable to align cutout 272 with discharge conduit 216 to prevent restriction of the flow out of sump 138. Accordingly, as best shown in FIG. 7, drain basin 206 may define one or more vertical ribs 274 that are generally configured for aligning drain cover 208 such that cutout 272 is directly aligned with discharge conduit 216. These vertical ribs 274 may simplify installation and prevent the positioning of drain cover 208 in the incorrect orientation.

Referring now generally to FIGS. 4 through 6 and 8, wash pump assembly 180 may be directly seated on and supported by drain cover 208. In this regard, according to the illustrated embodiment, drain cover 208 may define a support structure 276 that extends from a top surface 278 of drain cover 208 (e.g., out of the top of conical seat 262). In general, support structure 276 may be any structure intended to attach to or support wash pump assembly 180. For example, according to the illustrated embodiment, support structure 276 includes a plurality of ribs 280 that extend along the vertical direction V between conical seat 262 and pump housing 184 of wash pump assembly 180. For example, according to the illustrated embodiment, ribs 280 may generally extend from drain inlet 220 outward along the radial direction R. It should be appreciated that ribs 280 may have any suitable size, position, and orientation suitable for supporting wash pump assembly 180.

As explained above, drain cover 208 may be attached wash pump assembly 180 prior to installation within sump 138. In this regard, drain cover 208 may define a plurality of drain cover holes 282 through which mechanical fasteners 284 may pass to secure drain cover 208 to wash pump assembly 180. Specifically, as illustrated, drain cover 208 may define three drain cover holes 282 for receiving three fasteners 284 through the bottom surface 268 and upward along the vertical direction V into pump housing 184. Specifically, as illustrated, drain cover holes 282 may be defined through ribs 280 on drain cover 208. It should be appreciated that other attachment mechanisms and configurations may be used while remaining within the scope of the present subject matter.

Figure 5:
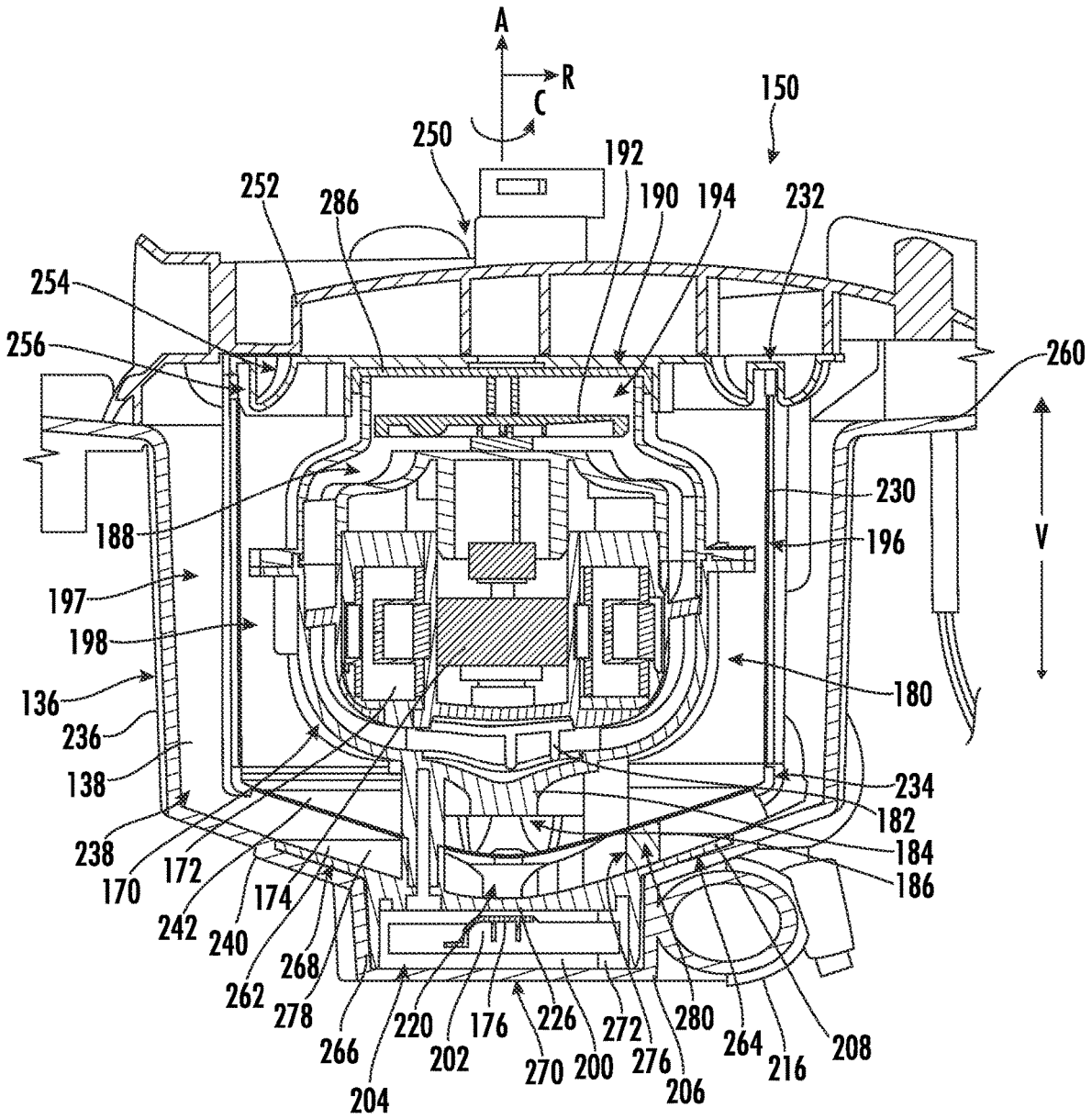
FIG. 5 provides a side, cross sectional view of the exemplary fluid circulation assembly of FIG. 3 according to an example embodiment of the present subject matter.

As explained above, wash pump assembly 180 may be seated directly on and attached to drain cover 208. In addition, filter screen 196 may be supported by wash pump assembly 180 and drain cover 208. In order to secure the assembly within sump 138, filter cleaning manifold 252 may be positioned over wash pump assembly 180 to engage wash pump assembly 180 and lock these components of fluid circulation assembly 150 within sump 138. For example, as best illustrated in FIGS. 4 and 5, filter cleaning manifold 252 may define a top end of a diverter chamber (e.g., such as diverter chamber 194) and may include a resilient overmolded material 286 that compresses against a top portion of wash pump assembly 180. In addition, when filter cleaning manifold 252 is installed, filter screen 196 may be seated within filter slot 256.

Figure 9:
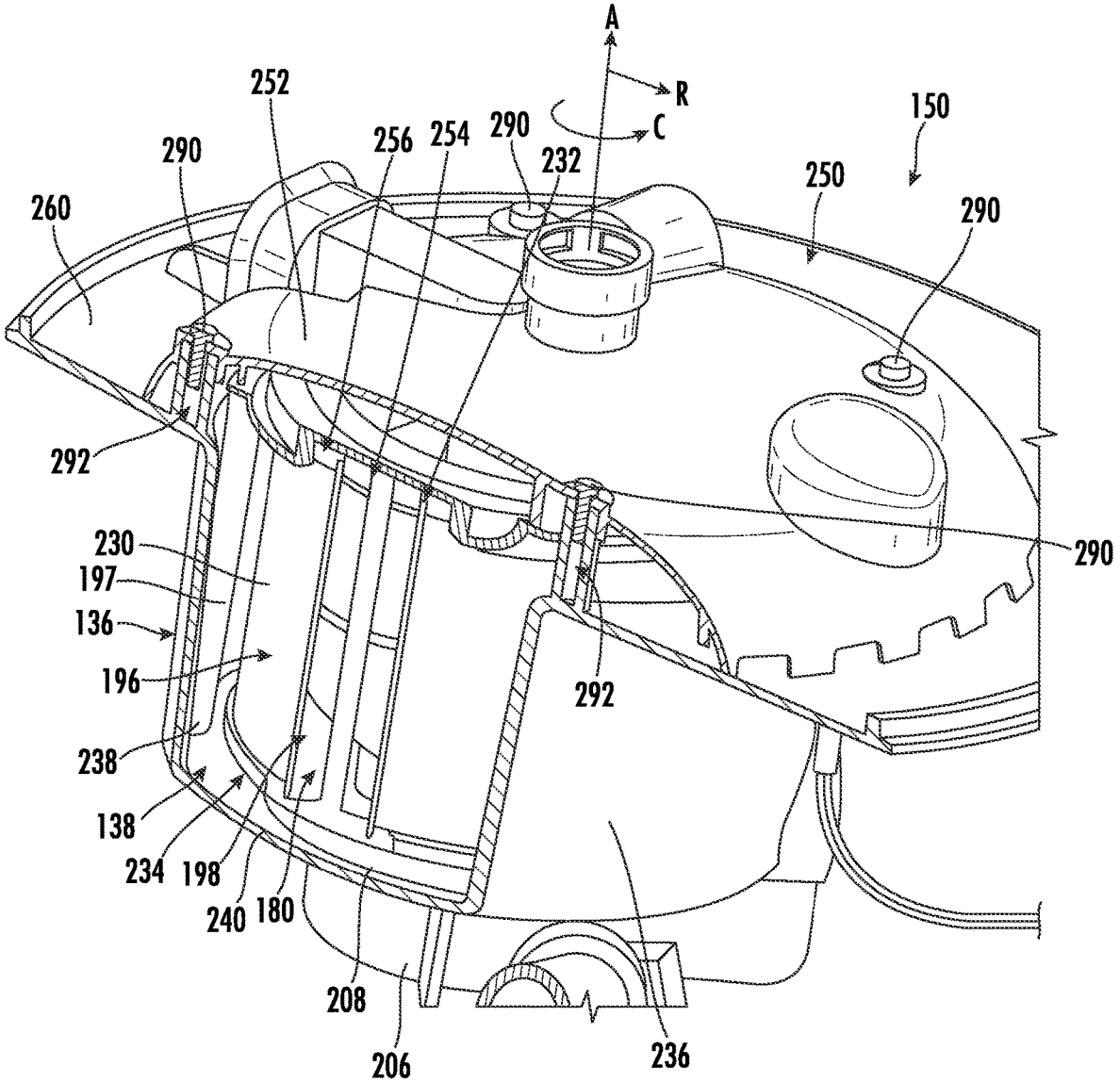
FIG. 9 provides a partial perspective view of a filter cleaning manifold attached to the sump to secure the exemplary fluid circulation assembly of FIG. 3 according to an example embodiment of the present subject matter.

In order to secure filter cleaning manifold 252 relative to sump housing 136 (e.g., thereby completing the installation of fluid circulation assembly 150), dishwasher appliance 100 may include mechanical fasteners 290 that pass through filter cleaning manifold 252 and into sump housing 136 to attach filter cleaning manifold 252 to sump housing 136 and to secure wash pump assembly 180 and filter cleaning manifold 252 within sump 138. Specifically, according to the illustrated embodiment and as best shown in FIGS. 3 and 9, sump housing 136 may define a plurality of screw bosses 292 that are generally configured for receiving mechanical fasteners 290. According to the illustrated embodiment, these screw bosses 292 are defined in the upper wall 260 of sump housing 136, e.g., outside of sump 138. Accordingly, when fasteners 290 are received within screw bosses 292, filter cleaning manifold 252 is secured in position relative to sump housing 136 and the remainder of wash pump assembly 180 and drain pump assembly 200 are sandwiched within sump 138.

As explained herein, aspects of the present subject matter are generally directed to a dishwasher appliance that features a wash system configuration with horizontal discharging drain pump. The system may include a drain pump volute that serves as the primary support for the wash system pump and filter assembly. A simple configuration of drain pump volute creates a top surface and an inlet to the drain pump. The volute surface may include ribs extending from a top surface to support the weight of the pump, the filter, the diverter, and the top manifold. Some additional features may include a radial ring on the surface of volute to form a partial seal, provisions to fix filter between the pump housing and drain volute via screws, and configurations of ribs to prevent improper installation of the wash system.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance defining a vertical direction, the dishwasher appliance comprising:
a wash tub that defines a wash chamber;
a sump housing defining a sump for collecting wash fluid, the sump housing defining a drain basin; and
a fluid circulation assembly positioned within the sump, the fluid circulation assembly comprising:
a drain cover seated within the drain basin;
a wash pump assembly seated on top of the drain cover;
a filter cleaning manifold positioned over the wash pump assembly;
a filter screen positioned within the sump surrounding the wash pump assembly, the filter screen extending along the vertical direction between the drain cover and the filter cleaning manifold; and
a plurality of mechanical fasteners that pass through filter cleaning manifold and into the sump housing to attach the filter cleaning manifold to the sump housing and to secure the wash pump assembly and the filter cleaning manifold within the sump.

2. The dishwasher appliance of claim 1, wherein the sump housing defines a plurality of features for receiving the plurality of mechanical fasteners.

3. The dishwasher appliance of claim 2, wherein the sump housing defines an upper wall above the sump along the vertical direction, wherein the plurality of screw bosses is defined in the upper wall.

4. The dishwasher appliance of claim 1, wherein the drain cover defines a support structure extending from a top surface of the drain cover upward along the vertical direction for supporting the wash pump assembly.

5. The dishwasher appliance of claim 4, wherein the support structure comprises a plurality of ribs extending from a drain inlet outward along a radial direction.

6. The dishwasher appliance of claim 5, wherein the plurality of ribs contacts a pump housing of wash pump assembly.

7. The dishwasher appliance of claim 1, wherein the drain cover defines a plurality of drain cover holes configured for receiving cover fasteners to secure the drain cover to the wash pump assembly.

8. The dishwasher appliance of claim 7, wherein the plurality of drain cover holes is defined through a plurality of ribs defined on the drain cover.

9. The dishwasher appliance of claim 1, wherein the sump housing defines a conical recess adjacent the drain basin and the drain cover defines a conical seat configured for receipt within the conical recess when in an installed position to form a substantial seal therebetween.

10. The dishwasher appliance of claim 1, wherein the drain cover defines a circumferential wall extending from a bottom surface of the drain cover for seating against a bottom wall of the drain basin, and wherein a cutout is defined in the circumferential wall.

11. The dishwasher appliance of claim 10, wherein a discharge conduit extends from the drain basin, and wherein the drain basin defines one or more vertical ribs for aligning the cutout of the drain cover with the discharge conduit.

12. The dishwasher appliance of claim 1, wherein
the filter screen defines a filtered region and an unfiltered region, wherein the filter cleaning manifold defines a filter receiving slot for receiving a top end of the filter screen.

13. A fluid circulation assembly for a dishwasher appliance, the dishwasher appliance defining a vertical direction and comprising a wash tub that defines a wash chamber and a sump housing defining a sump for collecting wash fluid, the sump housing defining a drain basin, the fluid circulation assembly comprising:
a drain cover seated within the drain basin;
a wash pump assembly seated on top of the drain cover;
a filter cleaning manifold positioned over the wash pump assembly;
a filter screen positioned within the sump surrounding the wash pump assembly, the filter screen extending along the vertical direction between the drain cover and the filter cleaning manifold; and
a plurality of mechanical fasteners that pass through filter cleaning manifold and into the sump housing to attach the filter cleaning manifold to the sump housing and to secure the wash pump assembly and the filter cleaning manifold within the sump.

14. The fluid circulation assembly of claim 13, wherein the sump housing defines a plurality of features for receiving the plurality of mechanical fasteners.

15. The fluid circulation assembly of claim 14, wherein the sump housing defines an upper wall above the sump along the vertical direction, wherein the plurality of screw bosses is defined in the upper wall.

16. The fluid circulation assembly of claim 13, wherein the drain cover defines a support structure extending from a top surface of the drain cover upward along the vertical direction for supporting the wash pump assembly.

17. The fluid circulation assembly of claim 16, wherein the support structure comprises a plurality of ribs extending from a drain inlet outward along a radial direction.

18. The fluid circulation assembly of claim 17, wherein the plurality of ribs contacts a pump housing of wash pump assembly.

19. The fluid circulation assembly of claim 13, wherein the sump housing defines a conical recess adjacent the drain basin and the drain cover defines a conical seat configured for receipt within the conical recess when in an installed position to form a substantial seal therebetween.

20. The fluid circulation assembly of claim 13, wherein the drain cover defines a circumferential wall extending from a bottom surface of the drain cover for seating against a bottom wall of the drain basin, and wherein a cutout is defined in the circumferential wall, and wherein a discharge conduit extends from the drain basin, and wherein the drain basin defines one or more vertical ribs for aligning the cutout of the drain cover with the discharge conduit.

* * * * *